US007008081B2

(12) United States Patent
Lunt

(10) Patent No.: US 7,008,081 B2
(45) Date of Patent: Mar. 7, 2006

(54) UNDERWATER LIGHT

(76) Inventor: Gary W. Lunt, P.O. Box 895, Port Aransas, TX (US) 78373

( * ) Notice: Subject to any disclaimer, the term of this patent is extended or adjusted under 35 U.S.C. 154(b) by 0 days.

(21) Appl. No.: 10/774,789

(22) Filed: Feb. 9, 2004

(65) Prior Publication Data

US 2005/0174774 A1 Aug. 11, 2005

(51) Int. Cl.
*F21V 29/00* (2006.01)

(52) U.S. Cl. ..... 362/267; 362/101; 362/158

(58) Field of Classification Search ..... 362/267, 362/101, 158
See application file for complete search history.

(56) References Cited

U.S. PATENT DOCUMENTS

| | | | | |
|---|---|---|---|---|
| 1,745,901 A | | 2/1930 | McKay | |
| 3,005,908 A | | 10/1961 | Farina | |
| 3,946,263 A | | 3/1976 | Protzeller | |
| 4,500,151 A | | 2/1985 | Ayers | |
| 4,598,346 A | | 7/1986 | Bodde | |
| 4,869,683 A | | 9/1989 | Nelson | |
| 5,607,224 A | * | 3/1997 | Tobias et al. | 362/101 |
| 6,158,873 A | * | 12/2000 | Griffiths | 362/158 |
| 6,315,429 B1 | | 11/2001 | Grandolfo | |
| 6,491,407 B1 | * | 12/2002 | Beadle | 362/153 |
| 2002/0178641 A1 | | 12/2002 | Kent | |

* cited by examiner

*Primary Examiner*—John Anthony Ward
*Assistant Examiner*—Mark Tsidulko
(74) *Attorney, Agent, or Firm*—G. Turner Moller

(57) ABSTRACT

An underwater light includes a high intensity lamp placed in an enclosure that allows for easy lamp replacement in case of breakage or natural failure. Electrical wires are soldered to a metal fitting on the lamp. The metal fitting is received in a plastic nipple and the space between the fitting and nipple is filled with a sealant, leaving the ends of the wires exposed. The wires are connected by water proof twist-on wire connectors and the end of the lamp is enclosed by a rubber boot and an end cap. When the lamp burns out, it is easily replaced by fishing the light out of the water, removing the rubber boot to expose the twist-on wire connectors. The twist-on wire connectors are removed and the old lamp discarded. A new lamp is installed in reverse order.

6 Claims, 2 Drawing Sheets

UNDERWATER LIGHT

This invention relates to an underwater light, and more particularly to an underwater light which is easy to install and which is easy to replace the bulb.

BACKGROUND OF THE INVENTION

Underwater light sources have been installed for many years in order to illuminate canals in housing developments. These lights attract fish, provide illumination and generally are attractive.

There are problems with installing and maintaining prior art underwater lights. As a general rule, when the bulb of a prior art underwater light burns out, it is difficult and expensive to replace the bulb because of the construction of the assembly.

Underwater light assemblies are known in the prior art, such as in U.S. Pat. Nos. 1,745,901; 3,005,908; 3,946,263; 4,598,346 and 6,315,429 and printed application 2002/0178641. Of more general interest are U.S. Pat. Nos. 4,500,151 and 4,869,683.

SUMMARY OF THE INVENTION

This invention addresses the need of an underwater lighting system that is easily installed and inexpensively repaired by the consumer. Other systems advertise the need of the installation and the factory replacement of the lamp by trained individuals. The replacement of the lamp in this system is easily done by anyone familiar with the use of a soldering gun. Unlike other systems using a mogul socket or porcelain lamp holder, made by such manufacturers as Philips, to couple the lamp electrically to the wires, none is needed or used in this system. A simple yet very effective method of coupling the wires to the lamp is done by soldering, eliminating one component prone to failure.

This underwater lighting system can be easily placed in the water, which is typically a canal and be easily retrieved with minimal effort. Current systems use a non-flexible conduit to enclose and protect the wire. This system uses a highly flexible conduit to protect the wire while enabling the simple procedure of deployment and retrieval.

This invention addresses the need of an underwater system that allows for the placement of the lamp in various depths of water. It is generally known that lamps placed approximately no deeper than 5 feet below the water surface allow both the desired brightness needed while allowing the lamp to be deep enough to insure sailboat keels and boat props from inadvertently damaging the lamp. The combination of new and different components allow for this result. These physical differences are substantial and significant. Previous references have not shown a combination of these components, resulting in an operational advantage to the user.

DETAILED DESCRIPTION

Figure 1:
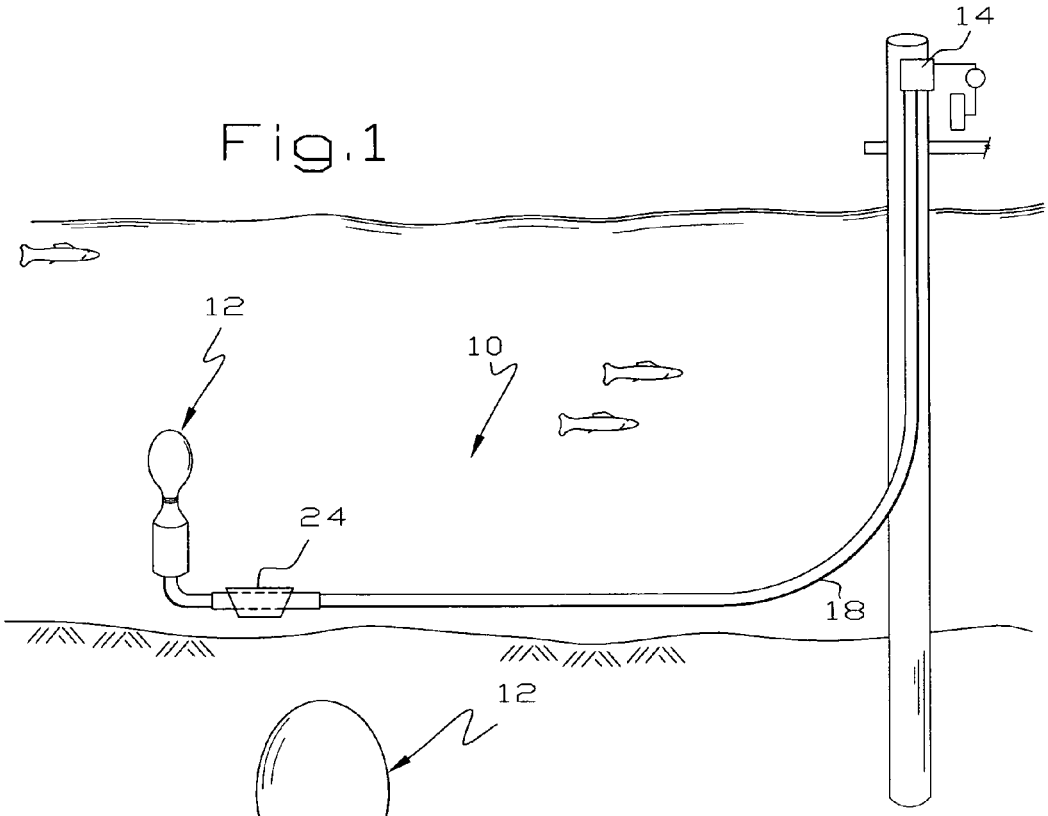
FIG. 1 is an overall schematic view of the underwater lighting system of this invention.
Figure 2:
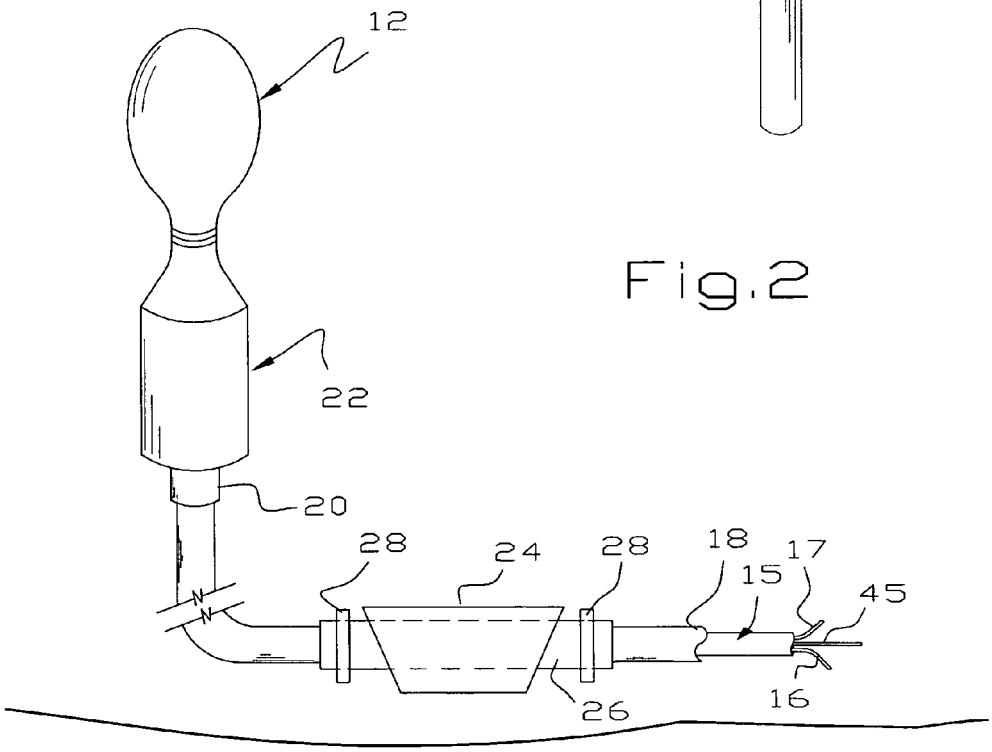
FIG. 2 is a side view of a high profile model used when water depth is greater than 7 feet.
Figure 3:
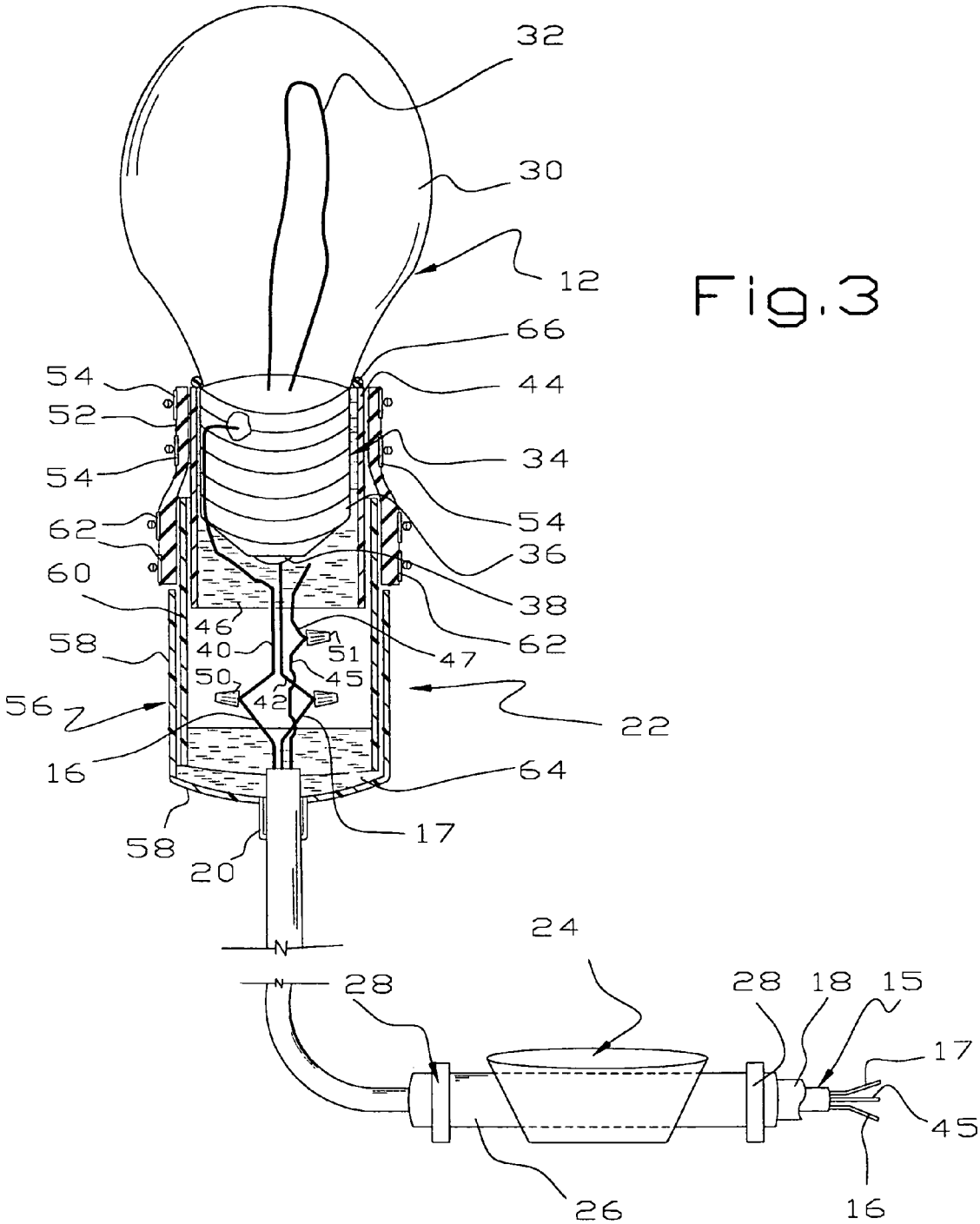
FIG. 3 is a view similar to FIG. 2, showing the lamp in enlarged cross-section compared to the weight assembly.

Referring to FIGS. 1–3, the underwater light 10 of this invention comprises a lamp 12 electrically coupled to a transformer 14 by a pair of suitable insulated wires 16, 17 being part of an insulated three wire assembly 15 received in and protected by a flexible conduit 18. Currently the preferred lamp 12 is a mercury vapor lamp, although any high intensity lamp may be used. Mercury vapor lamps have been used successfully by numerous builders of underwater lighting systems since the early to mid 1990's. The transformer 14 is controlled by a photoelectric eye (not shown) that automatically turns the light on at night and off at daybreak. The transformer 14 is coupled to an electrical source on shore using a ground fault circuit interrupter to meet electrical code requirements.

FIG. 2 shows a high profile model used when water depth is greater than 7 feet. The flexible conduit 18 is coupled directly to a PVC nipple 20 of a lamp enclosure 22. Lamps have been successfully placed in water to depths of 20 feet. This system does not use rebar or a ballasted receptacle to anchor the receptacle to the bottom. Instead, an adjustable weight 24, separate and unattached from the lamp enclosure, is incorporated. This moveable weight can be made from any material not susceptible to disintegration in water. Currently, the preferred substance is concrete.

The weight 24 is designed using a small length of 1¼" O.D. PVC pipe 26 running through the concrete. The PVC pipe 26 is only large enough to allow the flexible conduit 18 to enter and exit. The weight 24 is then run down the length of the flexible conduit 18 to a position pre-determined by water depth. The weight 24 is secured in place by stainless steel clamps 28 along a portion of the flexible conduit 7 which preferably are sufficiently large to prevent weight 24 from moving along the conduit 18. The moveable weight 24 not only allows for different depths of water levels but also allows flexibility for the lamp to move vertically in the water, thus helping to avoid objects that may hit and break the lamp. Rebar and other methods of weighting by previous systems are not needed. If more weight is needed for conditions where stronger currents are found, additional weights can be slid down the length of the conduit 18.

When water depths do not exceed 6 to 7 feet, a shallow water version of this invention may be devised simply by placing a rigid 90° ell attached to the nipple 20 at one end and to the flexible conduit 18 at the other end.

FIG. 3 shows the lamp 12 and the enclosure 22 of this invention. The lamp 12 includes a glass envelope or bulb 30 housing one or more electrically powered light producing elements 32 and a metal fitting 34 typically providing conventional screw threads 36 thereon and a central button 38 insulated from the metal fitting 34. The lamp 12 is accordingly of conventional design and would normally screw into a conventional porcelain lamp holder, such as a Philips mogul socket. Instead, in this invention, the metal conductors of a pair of insulated wires 40, 42 are soldered to the metal threads 36 and button 38 to provide the necessary electrical connection.

The lamp enclosure 22 comprises an electrically insulating nipple 44 juxtaposed to and preferably abutting the glass envelope 30 and receiving the metal fitting 34. The nipple 44 is typically made of a polymeric material, such as polyvinyl chloride polymer or other suitable plastic. The space between the lamp 12 and the nipple 44 is filled with a suitable sealant 46, which is preferably an epoxy sealant such as is available from Minnesota Mining and Manufacturing, Inc. of St. Paul, Minn. under the name SCOTCH- CAST. As shown in FIG. 3, the sealant 46 covers the button 38 and the ends of the wires 40, 42 thereby electrically isolating the lamp 12 from any water that might accidentally enter the lamp enclosure 22. Preferably, the sealant 46 extends to both ends of the nipple 44. Because most wires used inside the flexible conduit 18 include a ground wire 45, one end of an insulated wire 47 is embedded in the sealant 46 to provide an anchor for the ground wire 45.

The wires 40, 42 are connected to wires 16, 17 by water proof twist-on wire connectors 50 which are sufficient to keep water away from the metal conductors in the wires 16, 17, 40, 42. Suitable water proof twist-on wire connectors are commercially available from King Innovation of St. Charles, Mo. under the name DRYCONN. In the alternative, conventional twist-on wire connectors can be made water proof by injecting a sealant, such as the sealant 46, into the open end of the twist-on wire connectors 50. Although a water proof twist-on wire connector 51 may be used to connect the ground wire 45 to the wire 47, the twist-on wire connector 51 is preferably not waterproof so the ground fault indicator acting on the wire assembly 15 at the transformer 14 will shut off in the event water seeps into the lamp enclosure 22 and the wire 47 inside the sealant 46 has grounded to metal components of the lamp 12.

The lamp enclosure also comprises a rubber boot 52, which is typically a tapered rubber plumber's boot of suitable size, usually 2"×3", clamped to the nipple 44 by one or more suitable clamps 54, such as stainless steel or other noncorrodible hose clamps. The end of the boot 52 is closed of f by an electrically insulated cap 56 made from polyvinyl chloride or other suitable polymer providing an outlet into which the nipple 44 slips. The cap 56 includes an end cap 58 having a nipple 60 glued in the open end thereof to provide a sufficient length so the boot 52 may be easily clamped to the cap 56 by one or more clamps 62, such as stainless steel or other noncorrodible hose clamps. There is an advantage for the boot 52 to be tapered. The small end of the boot 52 allows the nipple 44 to slide inside. The large end of the boot 52 slides over the nipple 60 comprising part of the end cap 56 and provides sufficient room to tie a knot in the cable assembly 15. A potting compound 64, such as the same material as the sealant 46, covers the bottom of the end cap 58 and seals the enclosure 22 against water entry.

Manufacture and assembly of the underwater light should now be apparent. In a suitable shop, the conductors of the wires 40, 42 are soldered to the metal fitting 34 and button 38. The nipple 44 is placed over the metal fitting 34, the bulb 12 is inverted and the sealant 46 is poured into the nipple 44 and embedding the end of the wire 47 in the sealant 46. A bead of caulk 66 is applied between the base of the bulb 12 and the nipple 44.

At the installation location, the wire assembly 15 providing the wires 16, 17, 45 is run through a suitable length of the conduit 18, the weight 24 and its pipe 26 are installed on the conduit 18 at a suitable location, and the wire assembly 15 is passed through the nipple 44 and knotted. The twist-on wire connectors 50 are attached to the metal conductors of the wires 16, 17, 45, 40, 42, 47. The rubber boot 52 is then attached to the nipple 44 and to the end cap 56 and the underwater light 10 is placed in the water. In the event the water is very shallow, a rigid PVC ell (not shown) is attached to the nipple 44 and the weight 24 is positioned near the opposite end of the ell (not shown) to keep the light 10 near the bottom of the water.

An important feature of this invention is the ability to easily replace the lamp 12. When the lamp 12 burns out, the homeowner or repairman fishes the light 10 out of the water simply by pulling on the conduit 18. The clamps 54 are loosened and removed and the nipple 44 is removed from the boot 52, exposing the twist-on wire connectors 50. The wires electrically connecting the nipple 44 are disconnected by removing the exposed connectors 50, 51. A new lamp/nipple assembly is installed by connecting the wires of the new assembly to the existing wires 16, 17, 45 with new twist-on wire connectors 50, 51. The lamp/nipple assembly is then inserted back into the boot 52 and new clamps 54 are installed and tightened. The light 10 is ready to be placed back in the water. It will accordingly be seen that an important feature of this invention is that the lamp 12 is easy to replace and that, with the exception of the twist-on wire connectors 50, 51 and burned out bulb, every component of the underwater light 10 is reused thereby minimizing overall costs of this invention.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An underwater light comprising:

a high intensity lamp having a light generating member, a light transmitting envelope around the light generating member and a metal fitting sealing the envelope and electrically connected to the light generating member;

an electrically insulating nipple receiving the metal fitting and terminating adjacent the envelope;

first and second insulated electrical conductors electrically connected to the metal fitting and extending out of the nipple;

a curable electrically insulating sealant filling space between the metal fitting and the nipple and covering one end of the electrical conductors; and an enclosure including a resilient boot having a small end clamped to the nipple and a large end, and an end cap clamped to the large end of the resilient boot and having an outlet;

third and fourth electrical conductors extending through the end cap outlet;

waterproof wire connectors in the enclosure securing the first and second conductors to the third and fourth conductors; and a conduit attached to the end cap and communicating with the outlet, the third and fourth electrical conductors extending through the conduit.

2. The underwater light of claim 1 wherein the electrically insulating nipple is of a polymeric material and abuts the light transmitting envelope.

3. The underwater light of claim 1 wherein the waterproof wire connectors are twist-on wire connectors.

4. The underwater light of claim 1 wherein the metal fitting includes metal threads and a central button electrically insulated from the metal threads, the first and second conductors being soldered respectively to the metal threads and central button.

5. The underwater light of claim 1 wherein the sealant is an epoxy sealant.

6. The underwater light of claim 1 further comprising a ground wire parallel to the third and fourth electrical conductors, an anchor embedded in the sealant and a twist-on wire connector in the enclosure connecting the ground wire and the anchor.

* * * * *